US006010293A

United States Patent [19]

Uno

[11] Patent Number: 6,010,293

[45] Date of Patent: Jan. 4, 2000

[54] BOOK BINDING METHOD AND APPARATUS

[76] Inventor: Tadao Uno, 1-84, Matusgaoka 1-chome, Chigasaki-shi, Kanagawa-ken, Japan

[21] Appl. No.: 09/095,753

[22] Filed: Jun. 11, 1998

[30] Foreign Application Priority Data

Mar. 2, 1998 [JP] Japan ..... 10-049827

[51] Int. Cl.[7] ..... B42C 9/00

[52] U.S. Cl. ..... 412/8; 412/1; 412/35

[58] Field of Search ..... 412/1, 8, 4, 35; 281/27

[56] References Cited

U.S. PATENT DOCUMENTS 664,300 12/1900 Smyth ..... 412/35

2,024,959 12/1935 Alger ..... 412/35 X 2,570,544 10/1951 Guerra ..... 412/35 X 5,678,813 10/1997 Osako et al. ..... 412/35 X

FOREIGN PATENT DOCUMENTS 63-194865 12/1988 Japan .

7-45267 5/1995 Japan .

*Primary Examiner*—Willmon Fridie, Jr.

*Attorney, Agent, or Firm*—Wenderoth, Lind & Ponack, L.L.P.

[57] ABSTRACT

A book binding method includes binding a plurality of flatly superimposed leaves by a line of stitches of thread using a stitching machine, and folding the superimposed leaves in two along the line of stitches of thread to form a book. The stitches of thread of the superimposed leaves are impregnated with an anaerobic ultraviolet hardening type adhesive agent. A book binding apparatus is also disclosed.

5 Claims, 5 Drawing Sheets

BOOK BINDING METHOD AND APPARATUS

BACKGROUND OF THE INVENTION

This invention relates to a book binding method and a book binding apparatus for binding a book such as a passport or a bankbook, which is subjected to mechanical reading. More particularly, it relates to a book binding method and a book binding apparatus for binding a book with a rugged construction by a line of stitches of thread so as to be effective for prevention of counterfeiting.

In a typical conventional book binding method, a plurality of leaves flatly superimposed one upon another are bound at their center by a line of stitches of thread using a stitching machine and a cover is attached thereto. Then, the stitched flatly superimposed leaves are folded in two along the line of stitches of thread to form a book. Incidentally, it is necessary for such a book as a passport or a bankbook to be correctly mechanically readable and difficult to counterfeit. A book binding method satisfying such a need is disclosed, for example, in Japanese Patent Examined Publication (KOKOKU) No. 45267/95.

According to this conventional book binding method, after the flatly superimposed leaves forming inner pages are stitched with thread using a stitching machine, an adhesive agent is applied thereto along the entire length of the line of stitches of thread so that the adhesive agent is impregnated by capillary action of the stitched thread and then, the adhesive agent is dried to enhance hardening. Thereafter, the cover is attached to the leaves in such a manner as to conceal the line of stitches of thread.

Employed as a means for applying an adhesive agent is an adhesive discharge nozzle. The adhesive discharge nozzle is placed immediately under the line of stitches of thread of the flatly superimposed leaves, which are being conveyed in their flat condition along an upward inclination, with a discharge port of an adhesive agent discharge nozzle facing the line of stitches of thread. Owing to this arrangement, with the progress of the conveyance of the flatly superimposed leaves, an adhesive agent is applied directly to the line of stitches of thread from the discharge port of the nozzle. After the adhesive agent is applied, the stitched flatly superimposed leaves are transferred to a drying station where the adhesive agent is enhanced by hardening.

The book thus obtained is effective for prevention of counterfeiting because the leaves are bound or stitched by a line of stitches of thread impregnated with an adhesive agent. Moreover, the book thus obtained can be correctly mechanically be read because the adhesive agent is applied to the line of stitches of thread forming a part of the spine of the book and no raised portion is formed on the line of stitches of thread on the opening/closing side of the pages.

However, the above conventional book binding method has a drawback that considerable time is required for drying the adhesive impregnated in the thread and therefore, productivity is significantly decreased.

It has another drawback in that the adhesive agent flooded out of the discharge port of the adhesive discharge nozzle tends to be adhered to a non-required area in the vicinity of the line of stitches of thread, thus resulting in uneven coating of an adhesive agent. Particularly, when a limited amount of adhesive agent flooded out of a forward end of the adhesive agent discharge nozzle like a falling drop of water is applied directly to the line of stitches of thread while the flatly superimposed leaves are being conveyed, a proper amount of adhesive agent required in accordance with the speed of conveyance of the leaves cannot be supplied and thus the abovementioned problem for enhancing the uneven coating of adhesive agent is encountered.

The present invention has been accomplished in view of the above drawbacks inherent in the prior art.

SUMMARY OF THE INVENTION

It is, therefore, a general object of the present invention to provide a book binding method and a book binding apparatus capable of obviating the abovementioned drawbacks inherent in the prior art.

In order to achieve this object, there is essentially provided a book binding method in which a plurality of flatly superimposed leaves are bound by a line of stitches of thread using a stitching machine and the superimposed leaves are folded in two along the line of stitches of thread to form a book, wherein the line of stitches of thread of the superimposed leaves are impregnated with an anaerobic ultraviolet hardening type adhesive agent.

The ultraviolet hardening type adhesive agent may be hardened by an ultraviolet ray radiated from an ultraviolet ray radiating lamp.

From another aspect of the invention, there is also provided a plurality of flatly superimposed leaves bound along a line of stitches of thread using a stitching machine while conveying the leaves in their flat condition wherein the stitched flatly superimposed leaves are folded in two along the line of stitches of thread. An adhesive agent discharge nozzle and a rotor are arranged immediately under a passage of the stitched flatly superimposed leaves, an annular groove is formed in a peripheral surface of the rotor, and an adhesive agent discharged into the annular groove from the adhesive agent discharge nozzle is applied along the line of stitches of thread in accordance with rotation of the rotor.

A top of the line of stitches of thread preferably faces the interior of the annular groove.

A press roller for pressing the line of stitches of thread against the rotor is preferably provided.

It is preferred that a spatula for evenly flattening a coated surface of the adhesive agent is disposed immediately under the transfer passage of the stitched flatly superimposed leaves.

BRIEF DESCRIPTION OF THE DRAWINGS

A more complete application of the invention and many of the attendant advantages thereof will be readily obtained as the same becomes better understood by reference to the following detailed description when considered in connection with the accompanying drawings, wherein.

DETAILED DESCRIPTION OF THE EMBODIMENT

One embodiment of the present invention will now be described with reference to FIGS. 1 to 7B.

Figure 1:
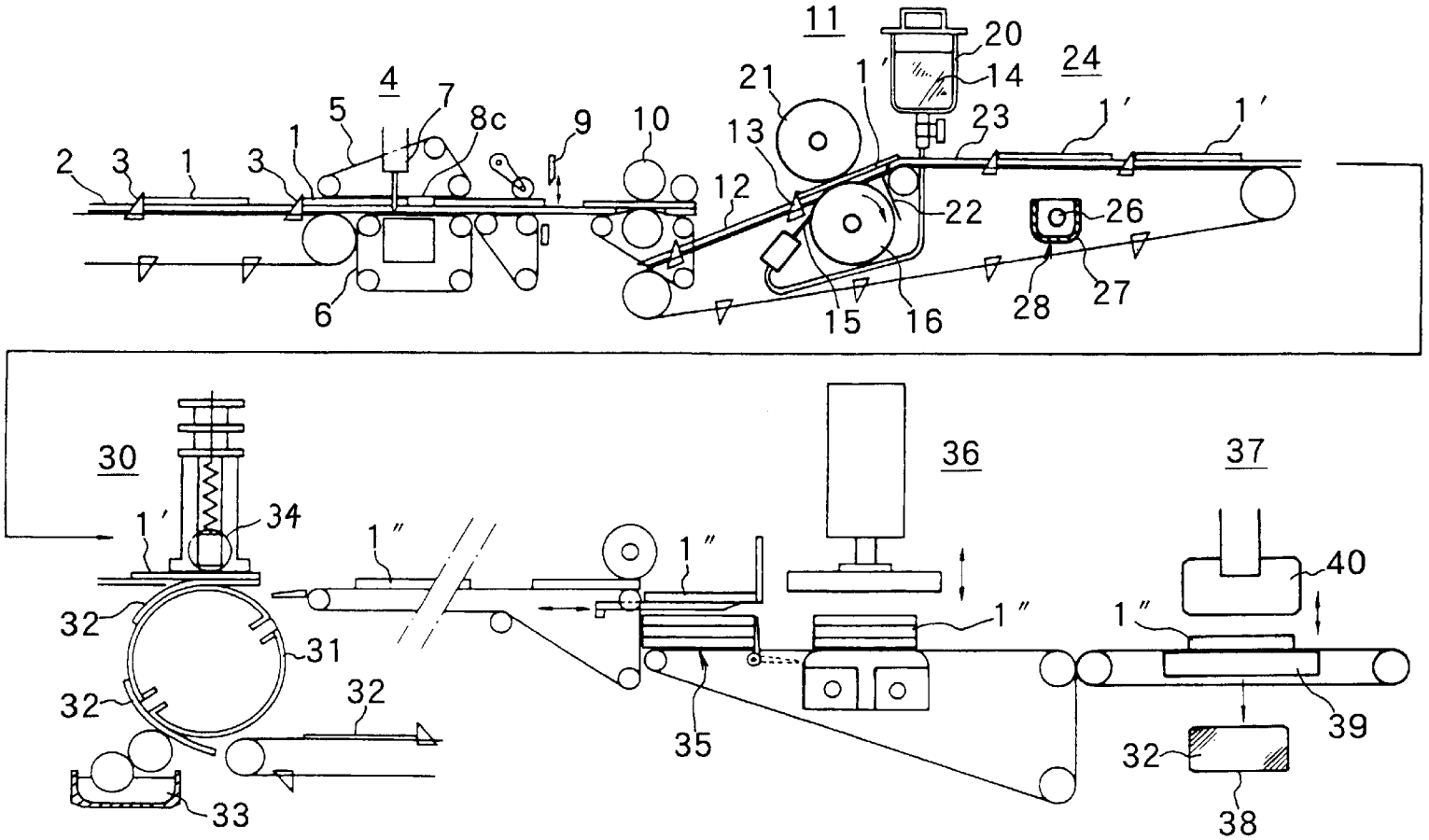
FIG. 1 is a schematic view of a book binding apparatus according to one embodiment of the present invention.
Figure 2A:
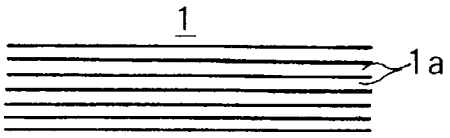
FIG. 2A is an enlarged view of a main portion showing flatly superimposed leaves in a book binding process according to the present invention.

FIG. 1 is a diagram showing an overall system for binding a book. In FIGS. 1 and 2A, reference numeral 1 denotes flatly superimposed leaves formed by superimposing a plurality of leaves 1*a* one upon another. The flatly superimposed leaves 1 are retained in their flat condition by a support plate forming a transfer passage 2 and transferred to a stitching station 4 by being pushed at a tail portion thereof by pushers 3 endlessly travelling along the transfer passage 2, while being regulated at an edge thereof by an edge regulator.

Figure 2B:
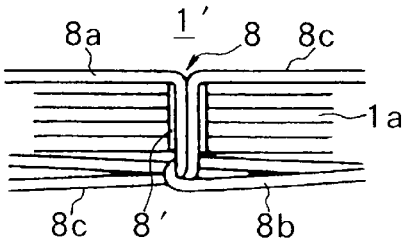
FIG. 2B is an enlarged view of the main portion showing a stitched state of the flatly superimposed leaves.
Figure 2C:
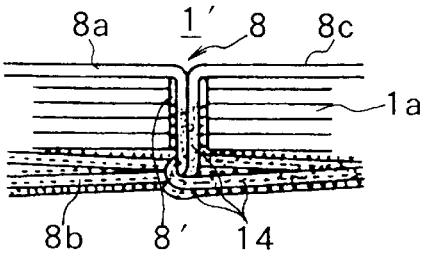
FIG. 2C is an enlarged view of the main portion showing a state in which the back thread of the stitched flatly superimposed leaves of FIG. 2B is impregnated with an adhesive agent.
Figure 2D:
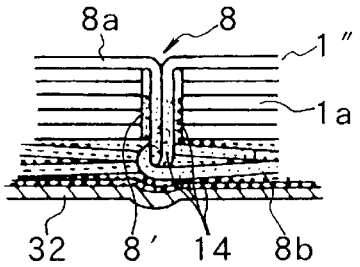
FIG. 2D is an enlarged view of the main portion showing a state in which a cover is attached to the stitched flatly superimposed leaves of FIG. 2C.
Figure 4B:
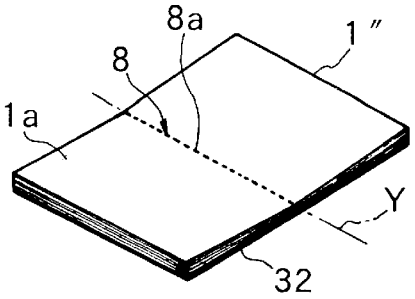
FIG. 4B is a perspective view of the book in its open position.
Figure 4A:
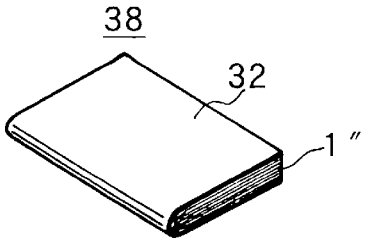
FIG. 4A is a perspective view showing a bookbound book.

In the stitching station 4, the flatly superimposed leaves 1 are held between an upper belt 5 and a lower belt 6 and transferred in that state. During the transfer, the flatly superimposed leaves 1 are stitched 8 at the center in a direction of transfer of the leaves 1 by a stitching machine 7 disposed on the transfer passage 2, as shown in FIGS. 2B, 4A and 4B. The stitched flatly superimposed leaves 1' includes a front thread 8*a* on the side where a stitching needle is inserted and a back thread 8*b* on the side where the stitching needle comes out and where the thread is double stitched in a loop shape, as shown in FIG. 2B. Accordingly, the front thread 8*a* appears on an upper surface side of the flatly superimposed leaves 1 transferred on the transfer passage 2, while the back thread 8*b* appears on a lower surface side thereof. Preferably, the back thread 8*b* is preliminarily attached with a reinforcing tape 8*d* to enhance the stitching strength.

After the flatly superimposed leaves 1 transferred one after another are subjected to the stitching 8, a stitching thread 8*c* connecting the stitched flatly superimposed leaves 1' is cut by a cutter 9. The respective stitched flatly superimposed leaves 1' thus cut are pressed by press rollers 10 and stretched, and then transferred to a gluing station 11.

Figure 6A:
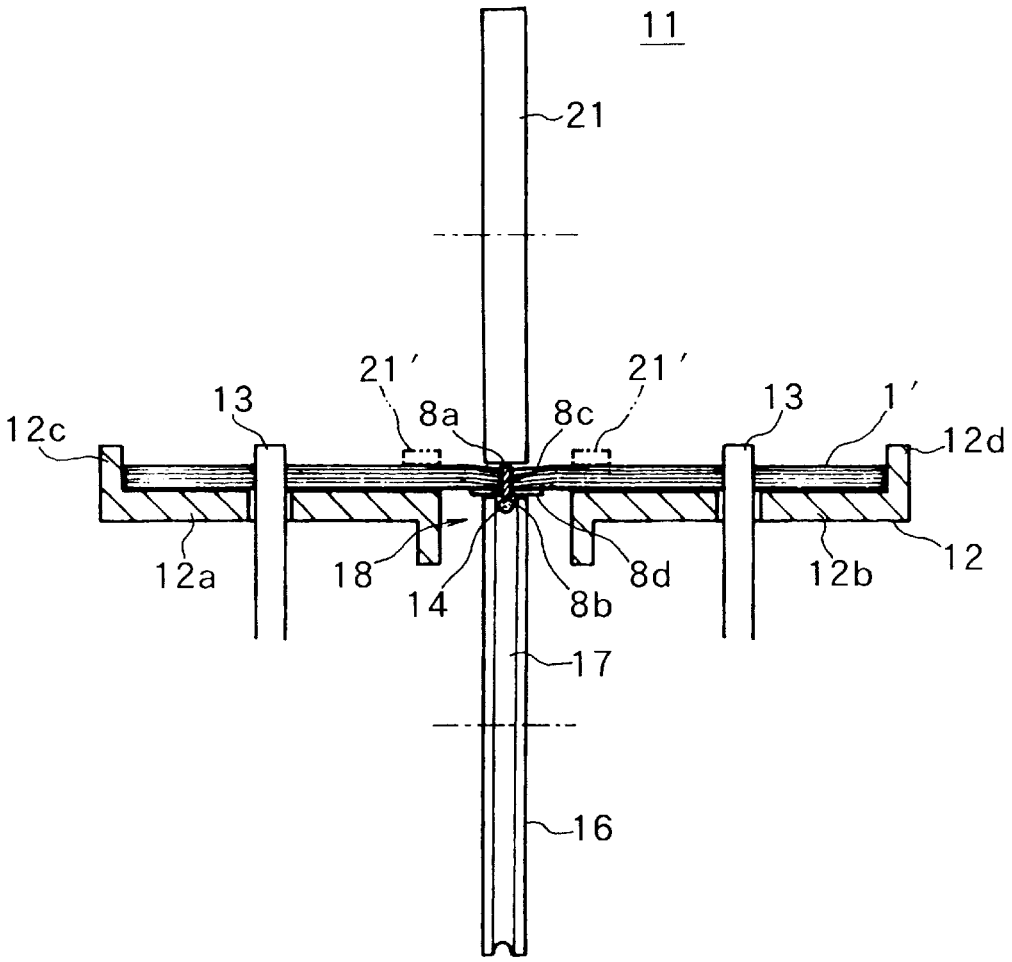
FIG. 6A is a sectional view showing an inclined transfer passage in the state of FIG. 5, when viewed from a lower end side of the inclined passage.

On an outlet side of the press rollers 10, there is provided an upwardly inclined transfer passage 12. As shown in FIG. 6A, the inclined passage 12 includes a right and a left support plate 12*a*, 12*b* arranged with a space 18 therebetween and adapted to support the stitched flatly superimposed leaves 1' and edge regulators 12*c*, 12*d* raised from outer sides of the support plates 12*a*, 12*b* and adapted to regulate the edge of the leaves 1'. The stitched flatly superimposed leaves 1' supported by the support plates 12*a*, 12*b* are pushed at their tail portions by a pusher 13 endlessly travelling along the inclined transfer passage 12 and regulated at the edge thereof by the edge regulators 12*c*, 12*d*. In the foregoing state, the stitched flatly superimposed leaves 1' are transferred. With the progress of the transfer of the stitched flatly superimposed leaves 1', an adhesive agent is applied along the back thread 8*b* of the leaves 1' as later described in greater detail. The adhesive agent is preferably an ultraviolet hardening type adhesive agent 14 which is in the form of a viscous liquid and not hardened in a normal condition. The ultraviolet hardening type adhesive agent 14 employed in this embodiment is of the type having anaerobic hardening properties.

Also, in this embodiment, the. inclination passage 12 may be a transfer passage capable of transferring at the same level as in the preceding step.

The ultraviolet hardening type adhesive agent 14 used in this embodiment is, for example, an anaerobic ultraviolet hardening type adhesive agent manufactured by Nippon Locktight Kabushiki Kaisha (located at 1-15-13, Fukuura, Kanazawa-ku, Yokohama-shi, Kanagawa-ken, Japan). This anaerobic ultraviolet hardening type adhesive agent 14 is instantaneously hardened and even the adhesive agent in needle holes 8', which agent is not subjected to radiation of the ultraviolet ray, is hardened by the anaerobic property of the agent. After hardening, the agent 14 becomes a thermosetting acrylic resin which is an adhesive agent/sealing agent having superb chemical resisting properties, cold/heat resisting properties, electrical insulating properties, adhesive strength and adhering properties and also having satisfactory durability. Moreover, since the anaerobic ultraviolet hardening type adhesive agent 14 is a single solution/undissolvable chemical reacting type adhesive agent, no volume contraction occurs.

As a means for applying the anaerobic ultraviolet hardening type adhesive agent 14, there are provided a rotor 16 disposed immediately under the inclined transfer passage 12 and capable of rotation in the direction of transfer, and an adhesive agent discharge nozzle 15 for discharging an adhesive agent disposed on the inlet side of the rotor 16 with respect to the leaves 1'.

The rotor 16 is a disc made of synthetic resin such as nylon, for example. An annular groove 17 is formed in and along a circumferential surface of the rotor 16.

Figure 6B:
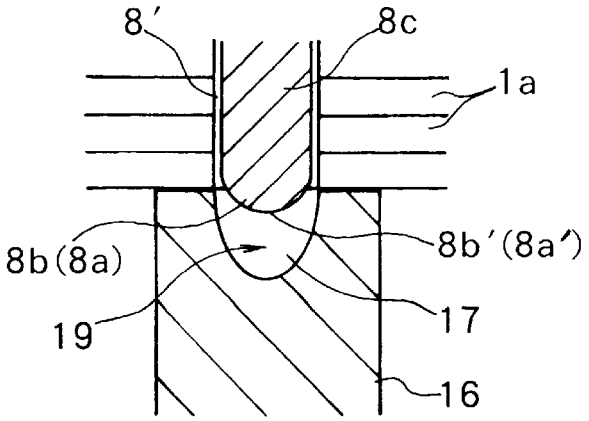

The rotor 16 is disposed immediately under the inclined transfer passage 12. As shown in FIG. 6, a part of a peripheral edge portion of the rotor 16 is inserted in the space 18 between the support plates 12*a*, 12*b* and the annular groove 17 is open to this space 18. That is, when the rotor 16 rotates about a predetermined axis, a part of the peripheral edge portion of the rotor 16 is inserted in the space 18, so that the back thread 8*b* of the stitched flatly superimposed leaves 1' transferred on the inclined transfer passage 12 faces the annular groove 17 in the space 18.

As shown in FIG. 6, the rotor 16 is in abutment or proximate relation at its circumferential surface to the stitched flatly superimposed leaves 1' such that the top portion 8*b*' of the back thread 8*b* faces the annular groove 17, and a space 19 is formed between the top portion 8*b*' of the thread 8*b* and an inner bottom surface of the groove 17. Accordingly, the rotor 16 is rotated about a predetermined axis always with the space 19 formed between the rotor 16 and the back thread 8*b* of the stitched flatly superimposed leaves 1' transferred one after another. The space 19 is the smallest space formed between the back thread 8*b* of the stitched flatly superimposed leaves 1' and the annular groove 17. In the space 19, the adhesive 14 discharged into the annular groove 17 from an adhesive agent discharge nozzle 15 is transferred from the inside of the annular groove 17 to the back thread 8*b*.

Figure 5:
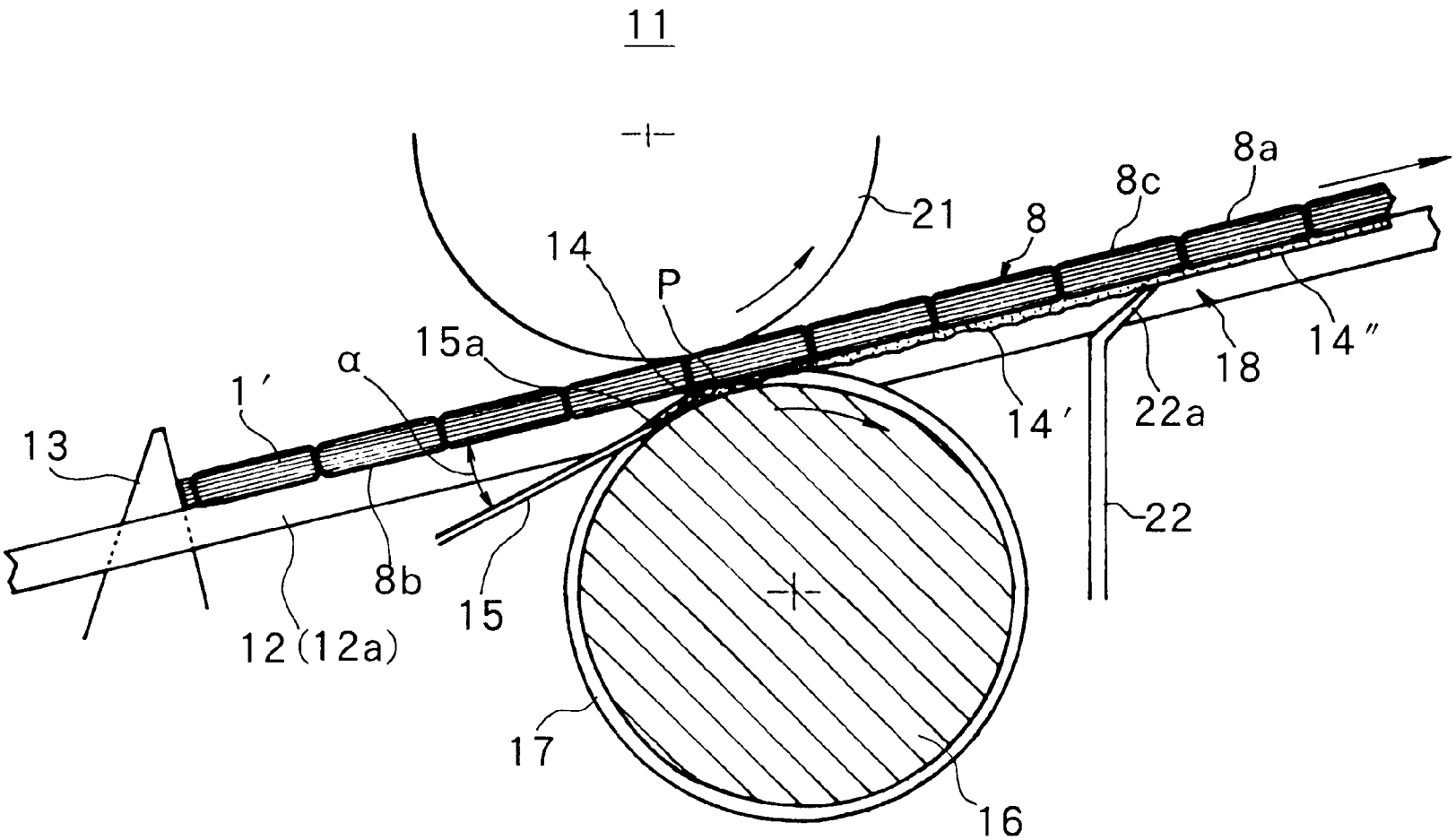
FIG. 5 is a side view, partly in section, showing a device for applying an adhesive agent to the stitched flatly superimposed leaves.

As shown in FIG. 5, the back thread 8*b* gradually shifted by the transfer of the stitched flatly superimposed leaves 1' is caused to face the annular groove 17 in the space 19 and allowed to pass along a transfer point P. The rotor 16 is rotated at the same speed as the travelling speed of the pusher 13 travelling along the inclined passage 12.

On the other hand, the adhesive agent discharge nozzle 15 is installed on the inlet side of the rotor 16 with respect to the leaves 1' and the nozzle 15 is placed at an inclination angle α with respect to the stitched flatly superimposed leaves 1' transferred along the inclined passage 12. The discharge port 15*a* of the adhesive agent discharge nozzle 15 opens within the annular groove 17 in the direction of transfer of the stitched flatly superimposed leaves 1'. In order for the discharged adhesive agent 14 to not immediately contact the back thread 8 at that time, the discharge port 15*a* is open before the transfer point P in the direction of rotation of the annular groove 17. A forward end of the adhesive agent discharge nozzle 15 is not in contact with the wall of the annular groove 17 so that rotation of the rotor 16 is not disturbed.

The adhesive agent discharge nozzle 15 is in the form of a needle. The ultraviolet hardening type adhesive agent 14 is pushed out of the discharge port 15*a* of the nozzle 15 under the head pressure of a glue tank 20 in which the adhesive agent 14 is reserved, so as to be pooled in the annular groove 17. The pooled adhesive agent 14 is shifted to the transfer point P, namely, the space 19, so that the adhesive agent 14 is transferred to the back thread 8*b* in accordance with rotation of the rotor 16.

The application of the ultraviolet hardening type adhesive agent 14 by the rotor 16 and the adhesive agent discharge nozzle 15 is carried out during the process for transferring the stitched flatly superimposed leaves 1' along upwardly inclined transfer passage 12. That is, the adhesive agent 14 is applied to the back thread 8*b* over its entire length while rotating the rotor 16 about a predetermined axis in the direction of transfer of the stitched flatly superimposed leaves 1'.

During the course of transfer of the stitched flatly superimposed leaves 1' from a downstream side to an upstream side along the inclined transfer passage 12, the adhesive agent 14 is applied to the back thread 8*b* over its entire length from an upper end of the inclination to a lower end thereof. That is, by causing the back thread 8*b* of the stitched flatly superimposed leaves 1' to pass over the annular groove 17 filled with the discharged ultraviolet hardening type adhesive agent 14, the adhesive agent 14 is impregnated in the back thread 8*b* over its entire length.

As one good example, as shown in FIGS. 5 and 6A, a press roller 21 for preventing the stitched 8 portion of the leaves 1' from rising is provided in opposing relation to the rotor 16 with the inclined passage 12 therebetween. The roller 21 is rotated in the same direction as the direction of transfer of the leaves 1' while pressing the stitched 8 portion of the leaves 1'. This press roller 21 is freely rotated without need of any driving force. Pressing plates 21' as indicated by imaginary lines in FIG. 6A are arranged on both sides of the press roller 21. The pressing plates 21' are each formed of a thin plate such as a stainless steel plate or the like. The pressing plates 21' press the stitched flatly superimposed leaves 1' against the support plates 12*a*, 12*b*.

The ultraviolet hardening type adhesive agent 14 applied to the back thread 8*b* over its entire length is penetrated into the stitching thread 8*c* and the needle hole 8' by capillary action of the stitching thread 8*c* so that the stitching thread 8*c* and the leaves 1*a* are intimately attached together. By virtue of its characteristics, the adhesive agent 14 penetrated from the back thread 8*b* of the stitched flatly superimposed leaves 1' is restricted from oozing out of the front thread 8*a* on the opening side of the book. By this, the ultraviolet hardening type adhesive agent 14 impregnated from the back thread 8*b* of the stitched flatly superimposed leaves 1' does not occur rise to the front thread 8*a* on the opening side of the book. Therefore, mechanical reading of a passport, a bank book or the like is not disturbed.

As a means for evenly flattening the adhesive applied surface 14' of the stitched flatly superimposed leaves 1', a spatula 22 is disposed immediately under the transfer passage in such a manner as to be adjacent to the outlet side of the rotor 16 with respect to the leaves 1'. The spatula 22 is formed of a stainless steel plate or the like. An upper end 22*a* of the spatula 22 is inclined at a clearance angle in the direction of transfer of the stitched flatly superimposed leaves 1' and resiliently flexibly contacted with the top portion of the back thread 8*b*.

The spatula 22 serves to remove irregularities on the adhesive agent applied surface 14' so that an evenly flattened adhesive agent applied surface 14" is formed. It also serves to remove uneven coating of the adhesive agent so that a book stitched with thread, and which is difficult counterfeit is obtained.

In the gluing step 11 mentioned above, the adhesive agent 14 to be used is not limited to the ultraviolet hardening type adhesive agent but other adhesive agents may be used.

As shown in FIG. 1, the stitched flatly superimposed leaves 1' with the ultraviolet hardening type adhesive agent 14 applied thereto and evenly flattened are horizontally returned from a terminal end of the inclination passage 12 to the next transfer passage 23 and then transferred to the adhesive hardening station 24 by the pusher 13. This transfer passage 23 is provided with a left and a right regulator 23*c*, 23*d* for regulating the opposite sides of the leaves 1' and a left and a right support plate 23*a*, 23*b* are arranged with a space 25 therebetween in the same manner as the inclined transfer passage 12. The adhesive agent applied surface 14" of the stitched flatly superimposed leaves 1' held on the transfer passage 23 in their flat condition is exposed through the space 25 to below the transfer passage 23.

As a means for hardening the ultraviolet hardening type adhesive agent 14, an ultraviolet ray radiating lamp 26 is employed. As such an ultraviolet ray radiating lamp 26, a high pressure mercury lamp or the like, capable of radiating an ultraviolet ray of a wavelength of 365 nm, for example, is used, so that the ultraviolet hardening type adhesive agent 14 is instantaneously hardened by radiating an ultraviolet ray thereto.

Figure 7A:
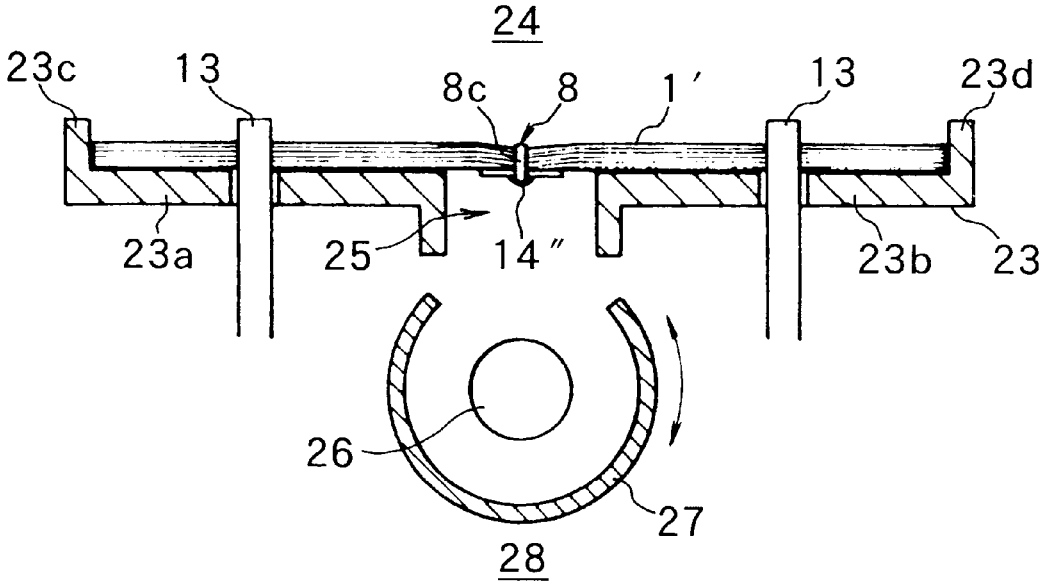
FIG. 7A shows a state of a device for hardening an ultraviolet hardening type adhesive agent, wherein an ultraviolet ray is being radiated to the ultraviolet hardening type adhesive agent.
Figure 7B:
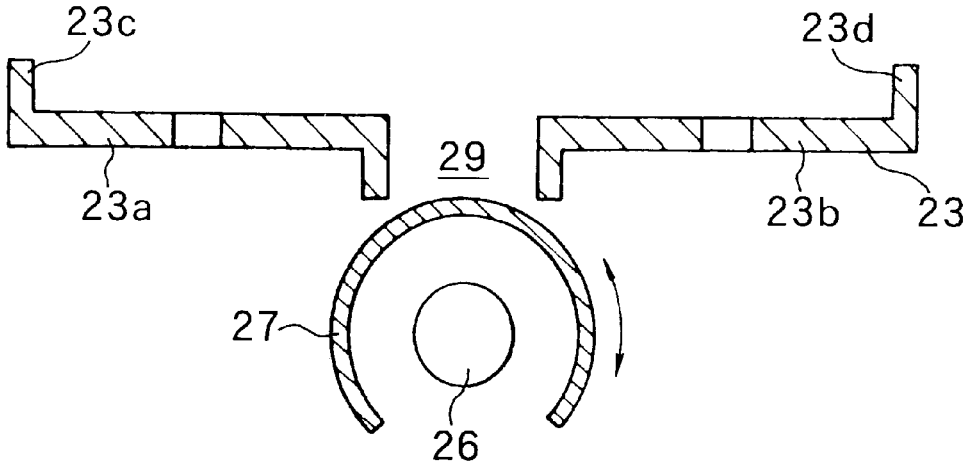
FIG. 7B is a sectional view of the same, wherein the device for hardening the ultraviolet hardening type adhesive agent is in its standby position.

As shown in FIGS. 7A and 7B, the ultraviolet ray radiating lamp 26 is disposed immediately under the transfer passage 23 so that the stitched flatly superimposed leaves 1' are passed immediately above the ultraviolet ray radiating lamp 26. By doing so, the ultraviolet ray is radiated to the ultraviolet hardening type adhesive agent 14 applied to the back thread 8*b* facing the space 25 between the support plates 23*a*, 23*b*. At that time, the ultraviolet ray may be radiated to the stitched flatly superimposed leaves 1' by stopping the leaves 1' immediately above the lamp 26 or the ray may be applied to the leaves 1' while transferring the leaves 1'.

The ultraviolet hardening type adhesive agent 14 is instantaneously hardened in the manner as mentioned above. After hardening, the agent 14 becomes a thermo-setting acrylic resin which is an adhesive agent/sealing agent having superb chemical resisting properties, cold/heat resisting properties, electricity insulating properties, adhesive strength and adhering properties and also having satisfactory durability. Thus, each leaf 1*a* and the stitching thread 8*c* are integrally hardened so that a binding with a rugged construction can be achieved.

The ultraviolet ray radiating lamp 26 is held in its ON-state and a shading hood 27 for shading the ultraviolet ray is attached to the lamp 26. The shading hood 27 is intermittently rotated about the lamp 26 between a radiating position 28 and a shading position 29.

As shown in FIGS. 1 and 7A, when the stitched flatly superimposed leaves 1' are transferred to immediately above the ultraviolet ray radiating lamp 26 by being pushed by the pusher 13, the shading hood 27 is rotated to the radiating position 28 to allow radiation of the ultraviolet ray to the adhesive agent 14. Upon detection of the stitched flatly superimposed leaves 1' by a sensor, for example, the shading hood 27 is rotated to the radiating position 28 to allow radiation of the ultraviolet ray to the agent 14 to enhance hardening thereof. After the leaves 1' have passed by the lamp 26, the shading hood 27 is rotated to the shading position 29 as shown in FIG. 7B.

Instead of the shading hood 27, that the ultraviolet ray radiating lamp 26 may be turned on upon detection of the stitched flatly superimposed leaves 1' by a sensor, and turned off after the adhesive agent 14 has been enhanced by hardening.

The stitched flatly superimposed leaves 1' with the adhesive agent 14 hardened are transferred to the next, cover attaching station 30.

In the cover attaching step 30, a cover supplying vacuum wheel 31 is disposed below the transfer passage 23. The cover 32 is drawn to the vacuum wheel 31 by suction in the vicinity of a lower dead point of the vacuum wheel 31 and transferred to an upper dead point along a peripheral surface of the vacuum wheel 31. During the process of transferring the cover 32, adhesive agent 33 is applied to the cover surface. Thereafter, the cover 32 is timingwise superimposed upon the leaf 1*a* on the back thread 8 side and adhered thereto under the pressure of a press roller 34.

Accordingly, the back thread 8*b* is hardened not only by the impregnation of the adhesive agent but also by the adhesive agent 33 for attaching the cover 32, and is concealed by the cover 32.

The stitched flatly superimposed leaves 1" attached with the cover are gathered at a stock portion 35 and stacked up. After a predetermined amount of the leaves 1" are stacked up, they are transferred to a post press station 36 where a strong pressure is applied to the leaves 1" from above so that the adhesive agent 33 is fixed and the leaves 1" are correctly flattened.

Then, the stitched flatly superimposed leaves 1" are transferred to the next, double folding station 37 where the leaves 1" are folded in two along the line Y of the stitches of thread (stitching thread 8*c*) thereby forming a book 38.

As the double folding means, a pair of folding rollers 39 are provided and a liftable folding plate 40 is disposed immediately above the transfer passage between the rollers 39. The folding plate 40 is inserted between the rollers 39 when lowered and held in an upper standby position between the rollers 38 when lifted upwardly. In the standby position, the stitched flatly superimposed leaves 1" are transferred such that the stitching thread 8*c* (the line Y of stitches of thread) is located immediately under the folding plate 40 and then, the folding plate 40 is lowered to push the leaves 1" between the folding rollers 39. As a result, the leaves 1" are double folded to form the book 38.

The book 38 thus formed is stitched with thread to have a rugged construction owing to the impregnation of the anaerobic ultraviolet hardening type adhesive agent 14 from the back thread 8*b* on the spine side attached with the cover and effective in prevention of counterfeiting. Since the adhesive agent 14 does not rise to the front thread 8*a* on the opening side, a mechanical reading can be performed without any interference.

Figure 3:
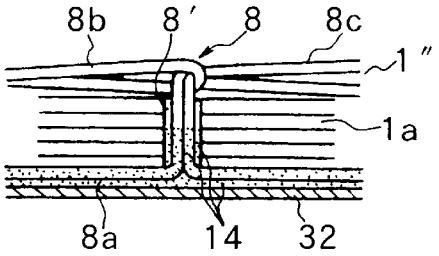
FIG. 3 is an enlarged view of another example of a main portion in the state of FIG. 2D.

In FIG. 3, according to the teaching of the present invention, after the flatly superimposed leaves 1 are transferred in their flat condition and stitched with thread by the stitching machine 7, the stitched flatly superimposed leaves 1' are inverted by an inverting device so that the front thread 8*a* on the needle inserting side of the stitching machine 7 and the back thread 8*b* on the other side are inverted. By doing so, the top portion 8*a*' of the front thread 8*a* on the lower surface side of the stitched flatly superimposed leaves 1' under transfer are faced with the annular groove 17 of the rotor 16 and the front thread 8*a* is subjected to gluing treatment in the same manner as mentioned above, so that the cover 32 can be attached to the leaf 1*a* on the glued front thread 8*a* side.

According to the present invention, owing to a provision of the adhesive agent charge nozzle and the rotor disposed immediately under the transfer passage of the stitched flatly superimposed leaves, an appropriate amount of adhesive agent can be applied only to the stitching thread of the leaves transferred from the annular groove in accordance with rotation of the rotor. Accordingly, a book binding having a difficult-to-release stitched portion can be obtained. Thus, when the invention is applied to a passport, a bank book, etc., there can be obtained a passport, etc. which is effective in prevention of counterfeiting. Moreover, the adhesive agent can be evenly applied even if the speed for transferring the book is increased. Therefore, productivity is enhanced.

Furthermore, by using an anaerobic ultraviolet hardening type adhesive agent as the abovementioned adhesive agent, the adhesive agent can instantaneously be hardened by the ultraviolet ray radiated from an ultraviolet radiating lamp. Therefore, the adhesive agent is enhanced in hardening strength in particular and the effect of preventing counterfeiting is enhanced. In addition, the time for hardening the adhesive agent can be reduced when compared with the prior art. The adhesive agent used in the present invention proves itself to be proper as an adhesive agent to be impregnated in the thread of a book.

Although this invention has been described in its preferred form with a certain degree of particularity, it is understood that the present disclosure of the preferred form has been made only by way of example and that numerous changes in the details of construction and arrangement of parts may be resorted to without departing from the spirit and the scope of the invention as hereinafter claimed.

What is claimed is:

1. A book binding method in which a plurality of flatly superimposed leaves are bound by a line of stitches of thread using a stitching machine and said superimposed leaves are folded in two along said line of stitches of thread to form a book, wherein said line of stitches of thread of said superimposed leaves are impregnated with an anaerobic ultraviolet hardening type adhesive agent, and wherein said ultraviolet hardening type adhesive agent is hardened by an ultraviolet ray radiated from an ultraviolet ray radiating lamp.

2. A book binding apparatus in which a plurality of flatly superimposed leaves are bound along a line of stitches of thread using a stitching machine while conveying said leaves in their flat condition and said stitched flatly superimposed leaves are folded in two along said line of stitches of thread, wherein an adhesive agent discharge nozzle and a rotor are arranged immediately under a passage of said stitched flatly superimposed leaves, an annular groove is formed in a peripheral surface of said rotor, and an adhesive agent discharged into said annular groove from said adhesive agent discharge nozzle is applied along said line of stitches of thread in accordance with rotation of said rotor.

3. A book binding apparatus according to claim 2, wherein a top of said line of stitches of thread faces the interior of said annular groove.

4. A book binding apparatus according to claim 2, wherein a press roller for pressing said line of stitches of thread against said rotor is provided.

5. A book binding apparatus according to claim 2, wherein a spatula for evenly flattening a coated surface of said adhesive agent is disposed immediately under said transfer passage of said stitched flatly superimposed leaves.

* * * * *